US009353988B2

(12) United States Patent
Liu et al.

(10) Patent No.: US 9,353,988 B2
(45) Date of Patent: May 31, 2016

(54) SHELF ASSEMBLY AND REFRIGERATOR COMPRISING THE SAME

(75) Inventors: Dongxian Liu, Anhui (CN); Jun Yao, Anhui (CN); Wei Ren, Anhui (CN); Jian Cheng, Anhui (CN); Lingyun Li, Anhui (CN)

(73) Assignees: HEFEI MIDEA REFRIGERATOR CO., LTD., Anhui (CN); HEFEI HUALING CO., LTD., Anhui (CN)

( * ) Notice: Subject to any disclaimer, the term of this patent is extended or adjusted under 35 U.S.C. 154(b) by 0 days.

(21) Appl. No.: 14/363,238

(22) PCT Filed: Dec. 31, 2011

(86) PCT No.: PCT/CN2011/085201

§ 371 (c)(1),
(2), (4) Date: Jun. 6, 2014

(87) PCT Pub. No.: WO2013/082845

PCT Pub. Date: Jun. 13, 2013

(65) Prior Publication Data

US 2015/0102718 A1 Apr. 16, 2015

(30) Foreign Application Priority Data

Dec. 5, 2011 (CN) ..... 2011 1 0399422
Dec. 6, 2011 (CN) ..... 2011 1 0402376

(51) Int. Cl.
*A47B 96/04* (2006.01)
*F25D 25/02* (2006.01)
(Continued)

(52) U.S. Cl.
CPC ..... *F25D 25/024* (2013.01); *F25D 23/00* (2013.01); *F25D 23/028* (2013.01); *F25D 25/02* (2013.01); *A47B 57/08* (2013.01)

(58) Field of Classification Search
CPC ..... F25D 23/065; F25D 23/00; F25D 23/028; F25D 2325/021; F25D 25/024; F25D 25/02
USPC ..... 312/408; 108/108–110
See application file for complete search history.

(56) References Cited

U.S. PATENT DOCUMENTS 2,549,879 A * 4/1951 Amore ..... F25D 25/02 211/134
3,162,416 A * 12/1964 Amarillas ..... A47B 57/34 248/244

(Continued)

FOREIGN PATENT DOCUMENTS

CN 2372641 Y 4/2000
CN 1677027 A 10/2005

(Continued)

OTHER PUBLICATIONS

International Search Report dated Aug. 2, 2012 for corresponding International Application No. PCT/CN2011/085201, filed Dec. 31, 2011.

(Continued)

*Primary Examiner* — Hanh V Tran
(74) *Attorney, Agent, or Firm* — David D. Brush; Westman, Champlin & Koehler, P.A.

(57) ABSTRACT

A shelf assembly and a refrigerator including the same. The shelf assembly includes: a shelf plate having first to fourth mounting members, and first to fourth brackets each having a fitting slot, in which the first and second brackets are disposed at a left and right side of the shelf plate respectively. The fitting slot of each of the first and second brackets includes a first sliding groove and a plurality of first receiving grooves. The first and second mounting members are slidable within the first sliding groove of the first and second brackets along the vertical direction so as to selectively fit within one of the plurality of the first receiving grooves. The third and fourth mounting members are fitted within the fitting slot of the third and fourth brackets and a position of the third and fourth mounting members are adjustable along the vertical direction.

9 Claims, 12 Drawing Sheets

(51) Int. Cl.

| | |
|---|---|
| ***F25D 23/00*** | (2006.01) |
| ***F25D 23/02*** | (2006.01) |
| *A47B 57/08* | (2006.01) |

(56) References Cited

U.S. PATENT DOCUMENTS

| | | | | |
|---|---|---|---|---|
| 3,742,868 | A * | 7/1973 | Garceau | A47B 5/04 108/39 |
| 4,250,815 | A * | 2/1981 | Swanson | A47F 5/13 108/108 |
| 5,004,302 | A * | 4/1991 | Stocking | A47B 57/42 108/107 |
| 5,483,902 | A * | 1/1996 | Grosch | A47B 21/02 108/143 |
| 5,895,020 | A * | 4/1999 | Danzyger | A47B 21/0314 248/295.11 |
| 6,584,916 | B1 * | 7/2003 | Felton | A47B 46/006 108/107 |
| 6,675,725 | B2 * | 1/2004 | Felton | A47B 46/005 108/107 |
| 7,131,681 | B2 * | 11/2006 | Kim | B60R 7/02 108/44 |
| 7,533,948 | B2 * | 5/2009 | Smith | A47B 55/02 108/107 |
| 8,424,692 | B2 * | 4/2013 | Ala | A47L 15/504 134/135 |
| 2003/0117051 | A1 | 6/2003 | Kweon | |
| 2004/0149182 | A1 | 8/2004 | Bienick et al. | |
| 2004/0150305 | A1 * | 8/2004 | Bienick | A47B 55/02 312/408 |
| 2005/0204966 | A1 * | 9/2005 | Bienick | A47B 57/48 108/108 |
| 2005/0217305 | A1 | 10/2005 | Park et al. | |
| 2005/0263474 | A1 | 12/2005 | Smith et al. | |
| 2006/0125362 | A1 * | 6/2006 | Kim | A47B 46/00 312/408 |
| 2006/0163985 | A1 * | 7/2006 | Blersch | F25D 23/067 312/408 |
| 2008/0030114 | A1 * | 2/2008 | Becke | A47B 57/425 312/408 |
| 2009/0121600 | A1 * | 5/2009 | Eisele | F25D 25/02 312/408 |
| 2010/0109496 | A1 | 5/2010 | Grasy et al. | |
| 2010/0270251 | A1 * | 10/2010 | Mejac | A47B 57/265 211/134 |
| 2011/0031863 | A1 * | 2/2011 | Benitsch | A47B 57/06 312/408 |
| 2012/0043874 | A1 * | 2/2012 | Simpson | F25D 23/067 312/408 |

FOREIGN PATENT DOCUMENTS

| | | | | |
|---|---|---|---|---|
| CN | 1888794 | A | 1/2007 | |
| CN | 1888795 | A | 1/2007 | |
| CN | 201844650 | U | 5/2011 | |
| CN | 102261805 | A * | 11/2011 | F25D 25/02 |
| DE | 102007005951 | A1 | 8/2008 | |
| KR | 20040065368 | A | 7/2004 | |

OTHER PUBLICATIONS

English translation of the Written Opinion of the International Searching Authority dated Jun. 5, 2014 for corresponding International Application No. PCT/CN2011/085201, filed Dec. 31, 2011.

Notification of Registration dated Feb. 6, 2013 for Chinese Application No. 201110399422.7.

Notification of Registration dated Apr. 18, 2014 for Chinese Application No. 201110402376.1.

English translation of the First Office Action dated Nov. 2, 2012 for corresponding Chinese Application No. 201110399422.7.

English translation of the First Office Action dated Mar. 18, 2013 for corresponding Chinese Application No. 201110402376.1.

English translation of the Second Office Action dated Nov. 14, 2013 for corresponding Chinese Application No. 201110402376.1.

* cited by examiner

SHELF ASSEMBLY AND REFRIGERATOR COMPRISING THE SAME

CROSS REFERENCE TO RELATED APPLICATIONS

This U.S. application claims priority under 35 U.S.C. 371 to, and is a U.S. National Phase application of, the International Patent Application No. PCT/CN2011/085201, filed Dec. 31, 2011, which claims the benefit of prior Chinese Application No. 201110399422.7 filed Dec. 5, 2011 and No. 201110402376.1 filed Dec. 6, 2011. The entire contents of the before-mentioned patent applications are incorporated by reference as part of the disclosure of this U.S. application.

FIELD

The present disclosure relates to the field of household appliance, and more particularly relates to a shelf assembly and refrigerator comprising the same.

BACKGROUND

The conventional adjustable shelf assembly of the refrigerator may be adjusted in two manners: the first manner is that the shelf is supported on the rib on the inner wall of the compartment of the refrigerator, when the shelf is needed to adjust, the shelf is pulled out of the compartment from a rib, then place the shelf into the compartment and support the shelf on another rib, so as to accomplish the vertical adjustment of the shelf; the second manner is that, a ferric support frame is disposed on the bottom of shelf and a cantilever beam is disposed on the inner wall of the compartment, and the support frame is connected with the cantilever beam via a hanging structure, the shelf can be adjusted vertically by adjusting the position of the cantilever beam.

The above two manners have defects, with the first manner, the adjustable distance of the shelf is limited by the distance between the ribs, so that the adjustment is complicated and inconvenient, with the second manner, the shelf assembly is heavy because of the adding support frame, and the shelf has to be rotated a certain angle when adjusted, therefore the adjustment manipulation of the shelf assembly is complicated.

SUMMARY

The present disclosure is directed to solve at least one of the problems in the related art to at least some extent.

An objective of the present disclosure is to provide a shelf assembly for refrigerator, the position of the shelf plate of the shelf assembly is adjustable in the vertical direction.

Another objective of the present disclosure is to provide a refrigerator comprising the shelf assembly.

Embodiments of a first aspect of the present disclosure provide a shelf assembly for a refrigerator, including: a shelf plate including first to fourth mounting members, and first to fourth brackets each having a fitting slot, in which the first bracket is disposed at a left side of the shelf plate, and the second bracket is disposed at a right side of the shelf plate, the fitting slot of each of the first and second brackets including a first sliding groove extended along a vertical direction and a plurality of first receiving grooves which are formed in a back wall of the first sliding groove, communicated with the first sliding groove respectively and spaced apart from each other along the vertical direction; in which the first mounting member is slidable within the first sliding groove of the first bracket along the vertical direction so as to selectively fit within one of the plurality of the first receiving grooves of the first bracket, the second mounting member is slidable within the first sliding groove of the second bracket along the vertical direction so as to selectively fit within one of the plurality of the first receiving grooves of the second bracket, the third mounting member is fitted within the fitting slot of the third bracket and a position of the third mounting member is adjustable along the vertical direction, and the fourth mounting member is fitted within the fitting slot of the fourth bracket and a position of the fourth mounting member is adjustable along the vertical direction.

With the shelf assembly according to embodiments of the present disclosure, the shelf plate can be supported on the brackets steadily, and the position of the shelf plate is adjustable along the vertical direction. Therefore, the structure of the shelf assembly is simple, and the position adjustment of the shelf plate is easy and convenient.

In some embodiments, the third bracket is disposed at the left side of the shelf plate and spaced apart from the first bracket along a front and back direction, the fourth bracket is disposed at the right side of the shelf plate and spaced apart from the second bracket along the front and back direction, the fitting slot of each of the third and fourth brackets including a second sliding groove extended along the vertical direction and a plurality of second receiving grooves which are formed in a back wall of the second sliding groove, communicated with the second sliding groove respectively and spaced apart from each other along the vertical direction, the third mounting member is slidable within the second sliding groove of the third bracket along the vertical direction so as to selectively fit within one of the plurality of the second receiving grooves of the third bracket, and the fourth mounting member is slidable within the second sliding groove of the fourth bracket along the vertical direction so as to selectively fit within one of the plurality of the second receiving grooves of the fourth bracket.

In some embodiments, the first to fourth mounting members are disposed on a bottom surface of the shelf plate, the first and third mounting members are extended beyond a left side surface of the shelf plate and spaced apart from each other in the front and back direction, the second and fourth mounting members are extended beyond a right side surface of the shelf plate and spaced apart from each other in the front and back direction.

In some embodiments, each of the first to fourth mounting members includes: a mounting block disposed on the bottom surface of the shelf plate and having a mounting hole; a support shaft fitted within the mounting hole and extended beyond the shelf plate; in which the support shafts of the first and second mounting members are slidable within the first sliding groove of the first and second brackets along the vertical direction so as to selectively fit within one of the plurality of the first receiving grooves of the first and second brackets, respectively, the support shafts of the third and fourth mounting members are slidable within the second sliding groove of the third and fourth brackets along the vertical direction so as to selectively fit within one of the plurality of the second receiving grooves of the third and fourth brackets, respectively.

In some embodiments, the support shafts of the first and second mounting members are integral with each other, and the support shafts of the third and fourth mounting members are integral with each other.

In some embodiments, left stopping members for abutting against the first and third brackets are disposed on the left side surface of the shelf plate and spaced apart from each other in the front and back direction, right stopping members for abutting against the second and fourth brackets are disposed on the right side surface of the shelf plate and spaced apart from each other in the front and back direction.

In some embodiments, a recess is formed in an inner wall of the mounting hole, and the support shaft has an anti-rotation protrude formed thereon and fitted within the recess.

In some embodiments, the shelf plate, the left and right stopping members, and the mounting blocks are integral.

In some embodiments, the third and fourth brackets are positioned in rear of the shelf plate and spaced apart from each other along a left-right direction, the third and fourth mounting members are disposed on a back surface of the shelf plate and spaced apart from each other along the left-right direction.

In some embodiments, the fitting slot of each of the third and fourth brackets includes a plurality of positioning grooves spaced apart from each other along the vertical direction; the third and fourth mounting members are selectively fitted within the positioning grooves of the third and fourth brackets respectively.

In some embodiments, the third and fourth mounting members are configured as positioning protrudes integral with the shelf plate.

In some embodiments, the positioning protrude is configured as a square post, and each of the positioning groove is configured as a square hole adapted to the positioning protrude.

In some embodiments, a flange extended backwards is formed on a top edge of the positioning groove.

In some embodiments, the first and second mounting members are disposed on the bottom surface of the shelf plate, the first mounting member is extended from the left side surface of the shelf plate, and the second mounting member is extended from the right side surface of the shelf plate; each of the first and second mounting members includes a support shaft and a mounting block disposed on the bottom surface of the shelf plate and having a mounting hole, the support shaft is fitted within the mounting hole and extended beyond the shelf plate, the support shafts of the first and second mounting member are slidable within the first sliding grooves of the first and second brackets along the vertical direction, so as to selectively fit within one of the first receiving grooves of the first and second brackets respectively.

In some embodiments, the support shafts of the first and second mounting members are integral with each other, a left stopping member for abutting against the first bracket is disposed on the left side surface of the shelf plate, and a right stopping member for abutting against the second bracket is disposed on the right side surface of the shelf plate.

In some embodiments, a recess is formed in the inner wall of the mounting hole, and the support shaft has an anti-rotation protrude formed thereon and fitted within the mounting hole.

In some embodiments, an arc transition surface is provided between the receiving groove and the sliding groove, and an arc recession is formed at a bottom of the receiving groove.

Embodiments of a second aspect of the present disclosure provide a refrigerator including: a cabinet defining a compartment therein; a door pivotably disposed on a front side of the cabinet for opening or closing the compartment; and a shelf assembly according to embodiments of the first aspect of the present disclosure, which is disposed in the compartment, and the first to fourth brackets are mounted on inner walls of the compartment.

In some embodiments, a first mounting groove extended along the vertical direction is formed in a left inner wall of the compartment, a second mounting groove extended along the vertical direction is formed in a right inner wall of the compartment, first mounting projections are disposed on the left inner wall of the compartment, close to a rear inner wall and spaced apart from each other in the vertical direction, second mounting projections are disposed on the right inner wall of the compartment, close to a rear inner wall and spaced apart from each other in the vertical direction, the first and second brackets are mounted in the first and second mounting groove respectively, the third bracket is mounted on the first mounting projections, and the fourth bracket is mounted on the second mounting projections.

In some embodiments, the first and second brackets are mounted in the first and second mounting grooves via snap-fit or by means of screws respectively, and the third and fourth brackets are mounted on the first and second mounting projections via snap-fit or by means of screws respectively.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference the accompanying drawings, in which.

DETAILED DESCRIPTION

Figure 1:
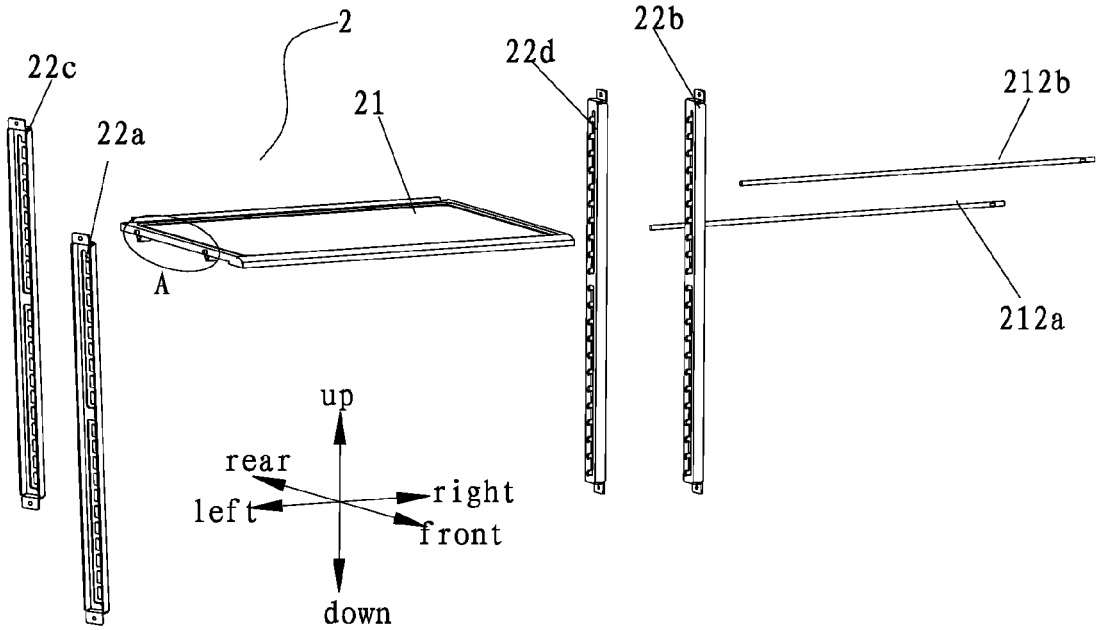
FIG. 1 is a schematic view of the shelf assembly for a refrigerator according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, Unless specified or limited otherwise, relative terms such as "longitudinal", "lateral", "front", "rear", "right", "left", "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance.

Terms concerning attachments, coupling and the like, such as "connected" and "interconnected", refer to a relationship wherein structures are secured or attached to one another either directly or indirectly through intervening structures, as well as both movable or rigid attachments or relationships, unless expressly described otherwise.

The shelf assembly for a refrigerator according to embodiments of the present disclosure will be described below with reference of FIG. 1 to FIG. 12.

As shown in FIGS. 1-12, a shelf assembly according to an embodiment of the present disclosure includes: a shelf 21, a first bracket 22*a*, a second bracket 22*b*, a third bracket 22*c*, and a fourth bracket 22*d*. To be specific, the shelf 21 has a first to fourth mounting member.

Each of the first bracket 22*a*, the second bracket 22*b*, the third bracket 22*c*, and the fourth bracket 22*d* has a fitting slot. The first bracket 22*a* is disposed at a left side (i.e., a left side shown in FIGS. 1 and 9) of the shelf plate 21. The second bracket 22*b* is disposed at a right side (i.e., a right side shown in FIGS. 1 and 9) of the shelf plate 21.

Figure 3:
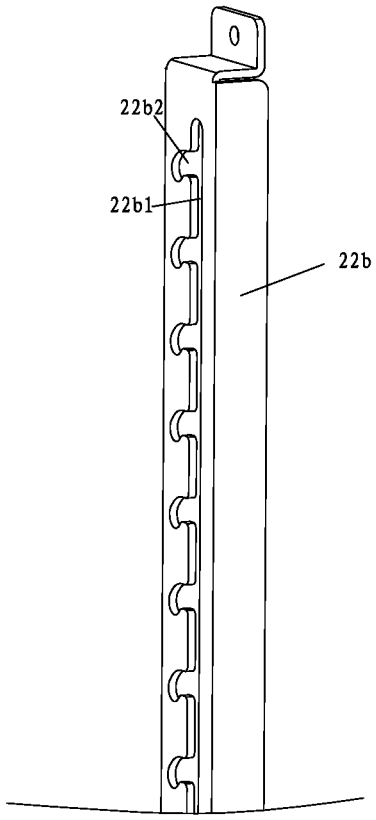
FIG. 3 is an enlarged schematic view of a portion of one bracket of the shelf assembly according to an embodiment of the present disclosure.

As shown in FIG. 3, by way of example and without limitation, the fitting slot of the second bracket 22*b* includes a first sliding groove 22*b*1 extended along a vertical direction and a plurality of first receiving grooves 22*b*2 which are formed in a back wall of the first sliding groove 22*b*1, communicated with the first sliding groove 22*b*1 respectively and spaced apart from each other along the vertical direction. The structures of the first bracket 22*a* and the second bracket 22*b* are symmetrical with each other in a left-right direction.

The first mounting member is slidable within the first sliding groove of the first bracket 22*a* along the vertical direction so as to selectively fit within one of the plurality of the first receiving grooves of the first bracket 22*a*. The second mounting member is slidable within the first sliding groove 22*b*1 of the second bracket 22*b* along the vertical direction so as to selectively fit within one of the plurality of the first receiving grooves 22*b*2 of the second bracket 22*b*.

The third mounting member is fitted within the fitting slot of the third bracket 22*c* and the position of the third mounting member is adjustable along the vertical direction. The fourth mounting member is fitted within the fitting slot of the fourth bracket 22*d* and a position of the fourth mounting member is adjustable along the vertical direction.

With the shelf assembly according to embodiments of the present disclosure, the shelf plate 21 is supported on the first to fourth brackets 22*a*, 22*b*, 22*c*, 22*d* via the first to fourth mounting members respectively and correspondingly, and positioned at a predetermined position and a predetermined level, so that the shelf plate 21 can be disposed on the brackets steadily, and the position of the shelf plate 21 is adjustable along the vertical direction. Therefore, the structure of the shelf assembly is simple, and the position adjustment of the shelf plate 21 is easy and convenient.

In some embodiments, as shown in FIG. 1, the third bracket 22*c* is disposed at the left side of the shelf plate 21 and spaced apart from the first bracket 22*a* along the front and back direction. The fourth bracket 22*d* is disposed at the right side of the shelf plate 21 and spaced apart from the second bracket 22*b* along the front and back direction. The third and fourth brackets 22*c* and 22*d* are symmetrical with each other, the structures of the third and first brackets may be identical, and the structures of the fourth and second brackets may be identical.

In other words, the fitting slot of each of the third and fourth brackets 22*c* and 22*d* includes a second sliding groove extended along the vertical direction and a plurality of second receiving grooves which are formed in a back wall of the second sliding groove, communicated with the second sliding groove respectively and spaced apart from each other along the vertical direction. The third mounting member is slidable within the second sliding groove of the third bracket 22*c* along the vertical direction so as to selectively fit within one of the plurality of the second receiving grooves of the third bracket 22*c*, and the fourth mounting member is slidable within the second sliding groove of the fourth bracket 22*d* along the vertical direction so as to selectively fit within one of the plurality of the second receiving grooves of the fourth bracket 22*d*.

Figure 2:
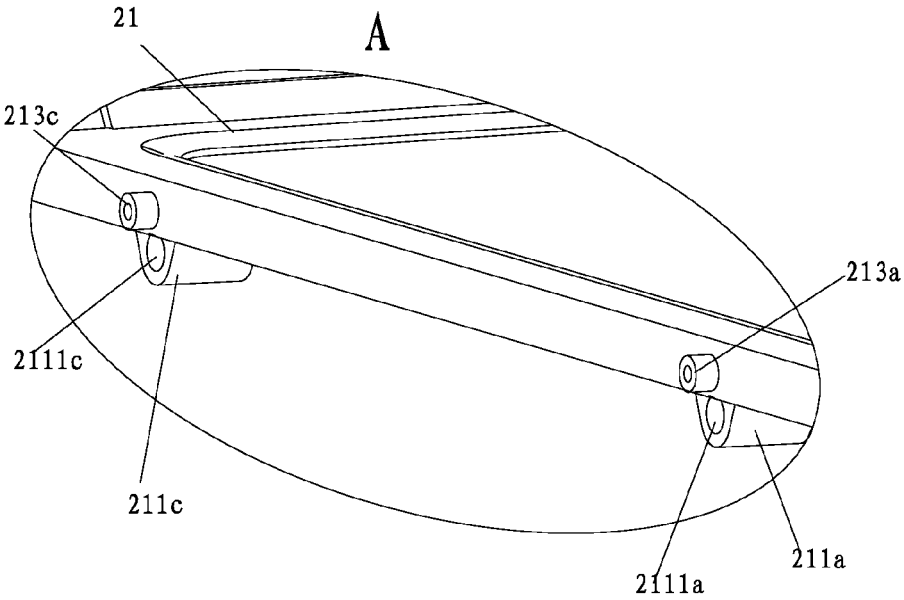
FIG. 2 is an enlarged schematic view of a portion indicated by Circle A in FIG. 1.
Figure 5:
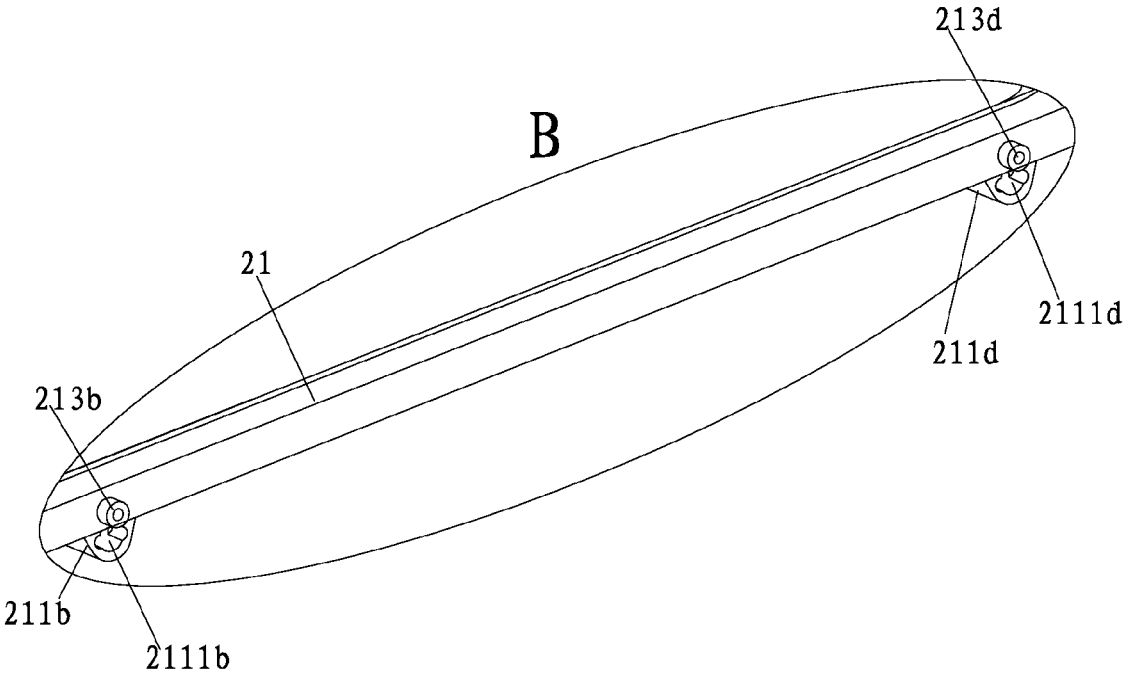
FIG. 5 is an enlarged schematic view of a portion indicated by Circle B in FIG. 4.
Figure 6:
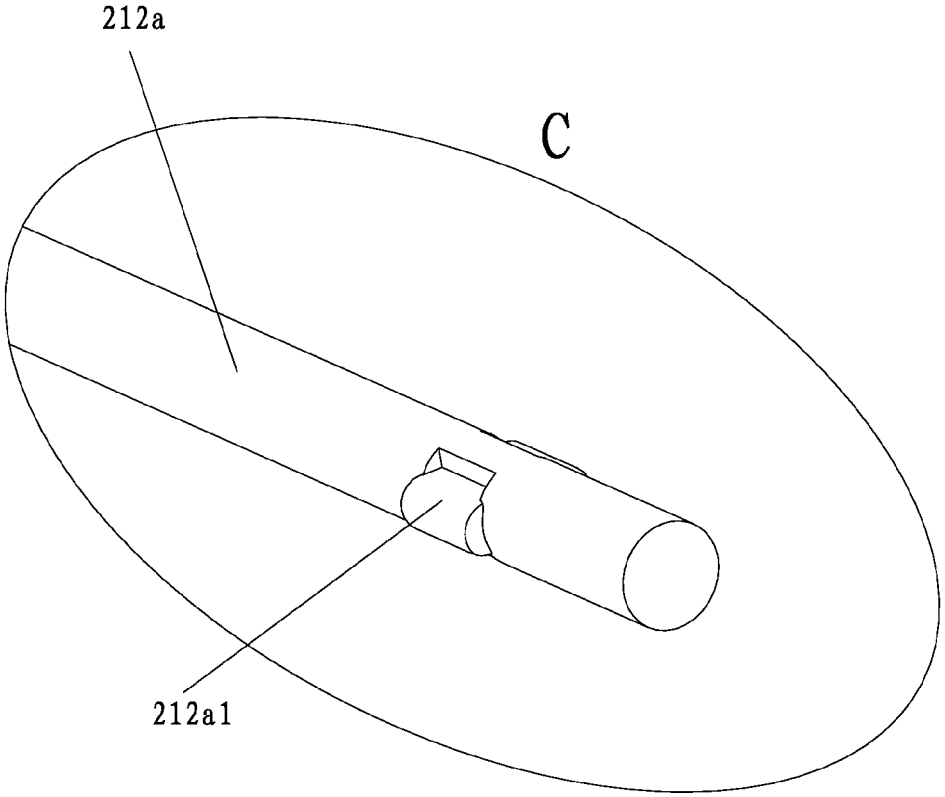
FIG. 6 is an enlarged schematic view of a portion indicated by Circle C in FIG. 4.
Figure 7:
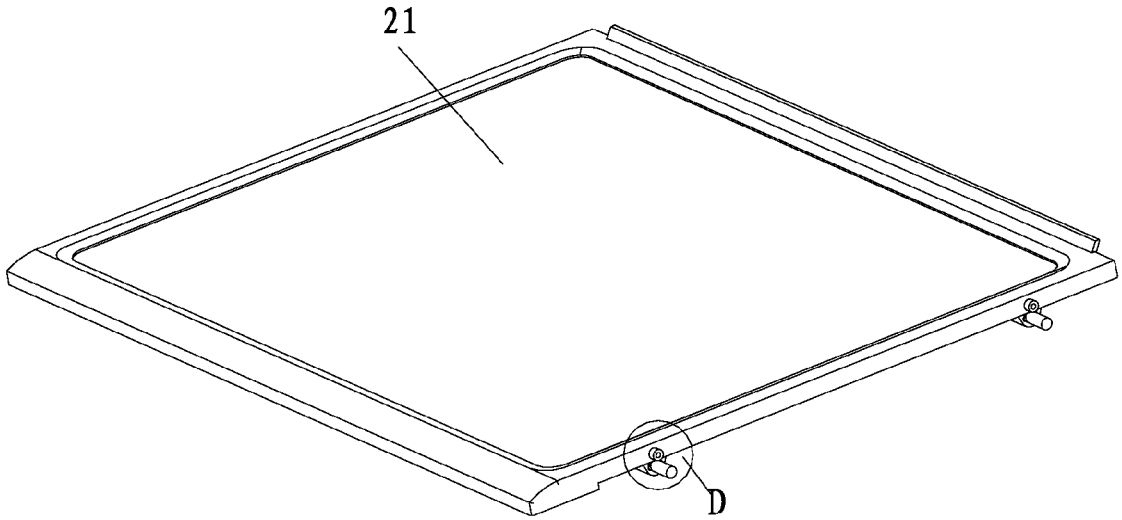
FIG. 7 is another schematic view of a shelf plate of the shelf assembly according to an embodiment of the present disclosure.
Figure 8:
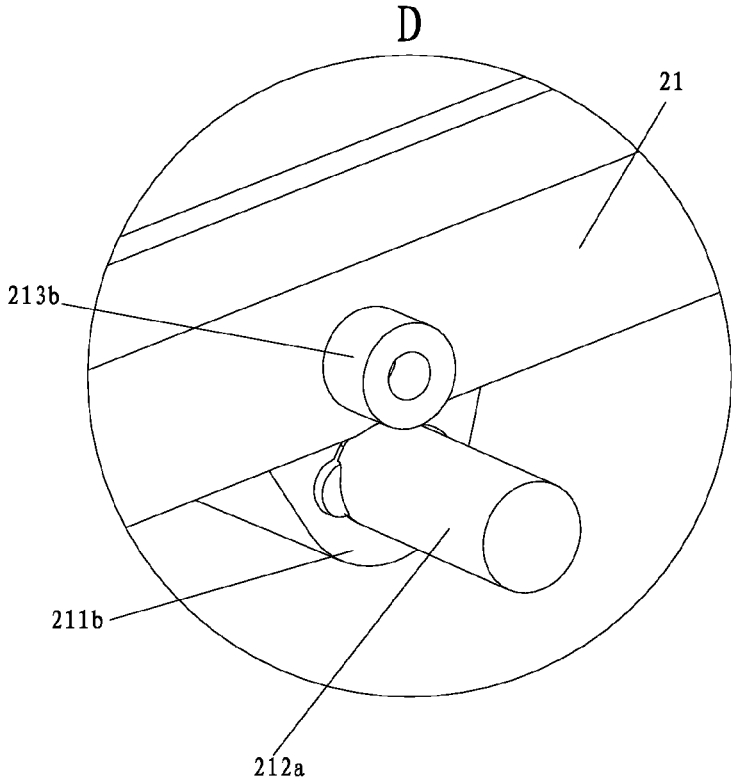
FIG. 8 is an enlarged schematic view of a portion indicated by Circle D in FIG. 7.
Figure 9:
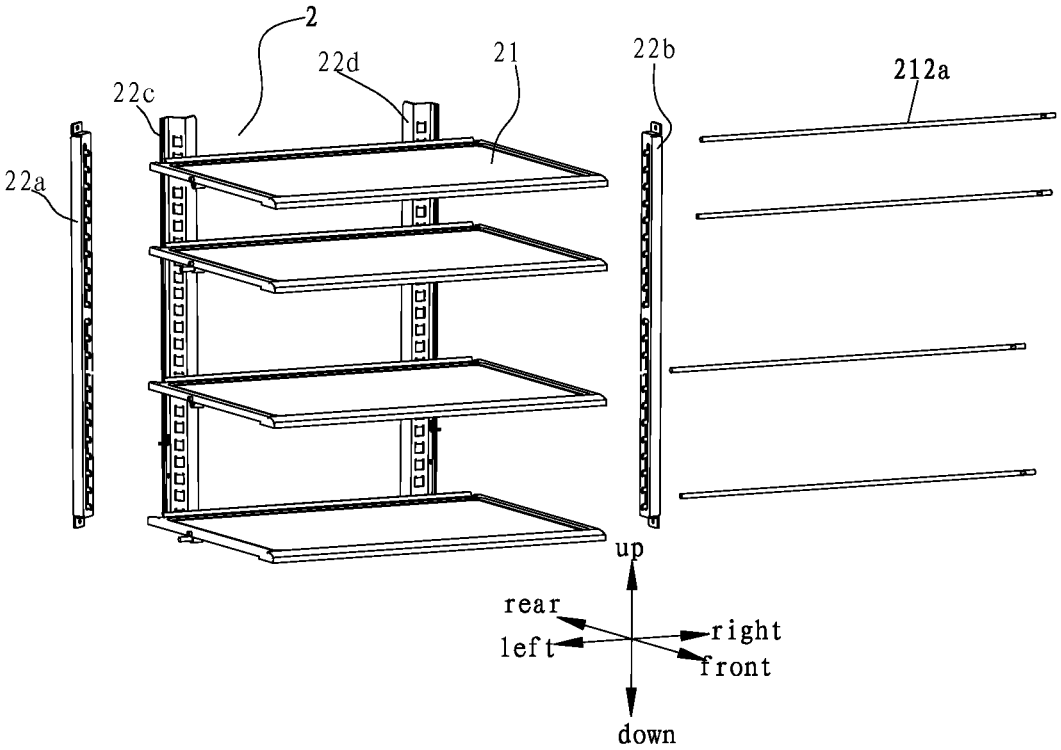
FIG. 9 is a schematic view of the shelf assembly for a refrigerator according to another embodiment of the present disclosure.

The first to fourth mounting members are disposed on a bottom surface of the shelf plate. Particularly, the first mounting member includes a mounting block 211*a* (as shown in FIG. 2) disposed on the bottom surface of the shelf plate 21 and having a mounting hole 2111*a*, and a support shaft fitted within the mounting hole 2111*a* and extended beyond the shelf plate 21. The second mounting member includes a mounting block 211*b* (as shown in FIG. 5) disposed on the bottom surface of the shelf plate 21 and having a mounting hole 2111*b*, and a support shaft fitted within the mounting hole 2111*b* and extended beyond the shelf plate 21.

Figure 4:
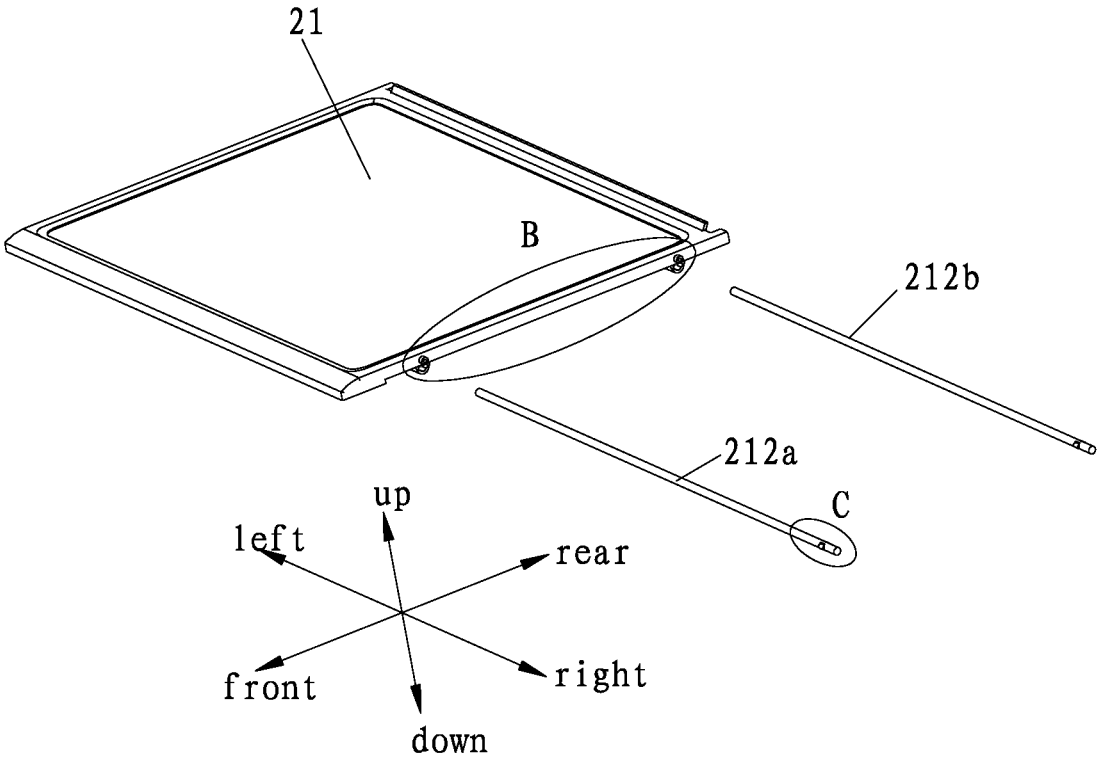
FIG. 4 is a schematic view of a shelf of the shelf plate of the shelf assembly according to an embodiment of the present disclosure.

The support shafts of the first and second mounting members are integral with each other, for example the support shaft 212*a* shown in FIG. 4. The third mounting member includes a mounting block 211*c* (as shown in FIG. 2) disposed on the bottom surface of the shelf plate 21 and having a mounting hole 2111*c*, and a support shaft fitted within the mounting hole 2111*c* and extended beyond the shelf plate 21. The fourth mounting member includes a mounting block 211*d* (as shown in FIG. 5) disposed on the bottom surface of the shelf plate 21 and having a mounting hole 2111*d*, and a support shaft fitted within the mounting hole 2111*d* and extended beyond the shelf plate 21. The support shafts of the third and fourth mounting members are integral with each other, for example the support shaft 212*b* shown in FIG. 4.

In other words, the first and third mounting members are extended beyond a left side surface of the shelf plate and spaced apart from each other in the front and back direction (i.e., the front and back direction shown in FIG. 1), the second and fourth mounting members are extended beyond a right side surface of the shelf plate and spaced apart from each other in the front and back direction. That is to say, the support shaft of the first mounting member is slidable within the first sliding groove of the first bracket along the vertical direction so as to selectively fit within one of the plurality of the first receiving grooves of the first bracket 22*a*.

The support shaft of the second mounting member is slidable within the first sliding groove of the second bracket along the vertical direction so as to selectively fit within one of the plurality of the first receiving grooves of the second bracket 22*b*. The support shaft of the third mounting member is slidable within the second sliding groove of the third bracket 22*c* along the vertical direction so as to selectively fit within one of the plurality of the second receiving grooves of the second bracket 22*c*.

The support shaft of the fourth mounting member is slidable within the second sliding groove of the fourth bracket along the vertical direction so as to selectively fit within one of the plurality of the second receiving grooves of the fourth bracket 22*d*.

Therefore, the shelf plate 21 can be positioned in corresponding receiving grooves of the first to fourth brackets 22*a*-22*d*. When the position of the shelf plate 21 needs to be adjusted, the support shaft is released from the corresponding receiving grooves and enters into the sliding groove, so as to move in the sliding groove along the vertical direction to adjust the position of the shelf plate 21, and positioned again in a predetermined receiving groove.

Advantageously, as shown in FIG. 3, the receiving groove 22*b*2 transitions into the sliding groove of the second bracket 22*b* via an arc transition surface, and an arc recession is formed at a bottom of the receiving groove 22*b*2. Therefore, when the position of the shelf plate 21 is adjusted, a friction resistance between the support shaft and the receiving groove as well as the sliding groove is reduced when the support shaft exits receiving groove and enters the sliding groove, so that the position of the shelf plate 21 may be adjusted easily.

Advantageously, in some embodiments, as shown in FIG. 2, left stopping members 213*a* and 213*c* for abutting against the first and third brackets 22*a* and 22*c* are disposed on the left side surface of the shelf plate 21 and spaced apart from each other in the front and back direction. Right stopping members 213*b* and 213*d* for abutting against the second and fourth brackets 22*b* and 22*d* are disposed on the right side surface of the shelf plate 21 and spaced apart from each other in the front and back direction. Therefore, intervals between the shelf plate 21 and any of the first to fourth brackets respectively are filled, thus preventing the shelf plate 21 from moving in the left-right direction. Alternatively, the shelf plate 21, the left stopping members 213*a* and 213*c*, the right stopping members 213*b* and 213*d*, and the mounting blocks 211*a*-211*d* are integral. Therefore, the shelf assembly according to embodiments of the present disclosure is facilitated to manufacture, and the assembling process is simplify.

As shown in FIGS. 4-8, in some embodiments, a recess (not shown) is formed in an inner wall of the mounting hole, and the support shaft has an anti-rotation protrude 212*a*1 formed thereon and fitted within the recess. Therefore, the rotation of the support shaft in the mounting hole is avoided, so that the fitting between the support shaft and the mounting hole is tight. The support shafts 212*a* and 212*b* are integral respectively, so that the anti-rotation protrude 212*a*1 is formed on one end of the support shaft 212*a* or 212*b*, and the recess is formed in the correspondingly end of the mounting hole of the mounting block, thus facilitating the manufacturing and mounting.

The shelf assembly for a refrigerator according to another embodiment of the present disclosure will be described below with reference of FIGS. 9-12.

In such an embodiment, the third and fourth brackets 22*c* and 22*d* are positioned in rear (i.e., the rear side in FIG. 9) of the shelf plate 21 and spaced apart from each other along a left-right direction (i.e., the left-right direction in FIG. 9); the third and fourth mounting members are disposed on a back surface of the shelf plate 21 and spaced apart from each other along the left-right direction.

Figure 10:
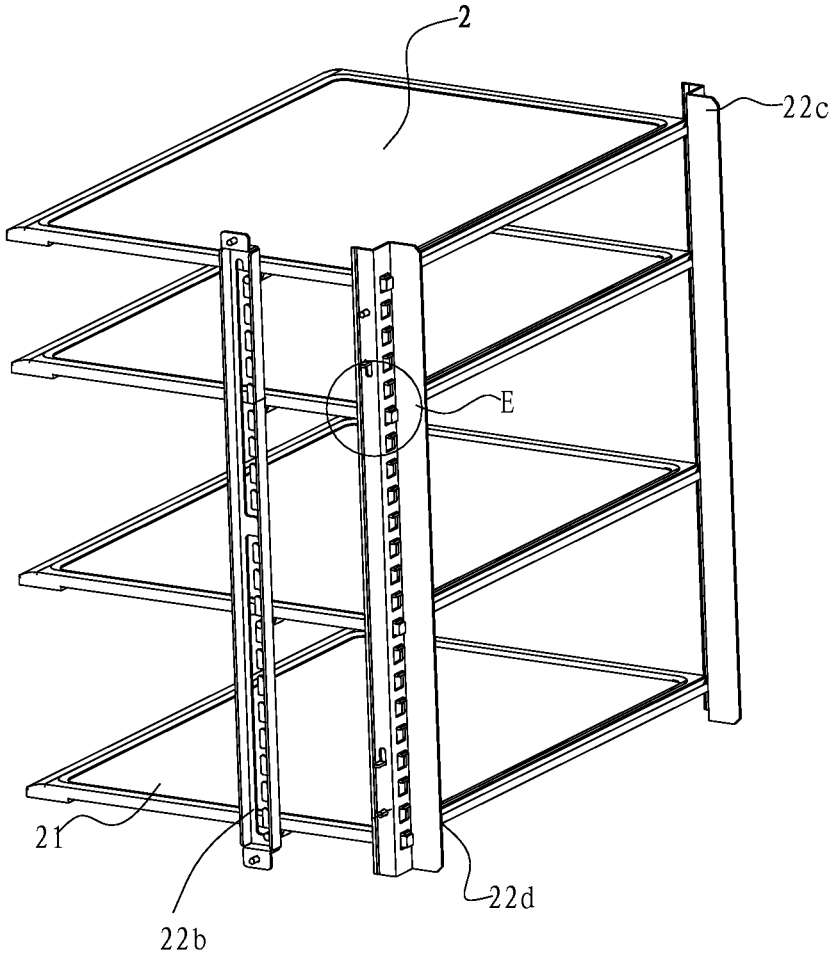
FIG. 10 is a schematic view of the shelf assembly for a refrigerator according to yet another embodiment of the present disclosure.
Figure 11:
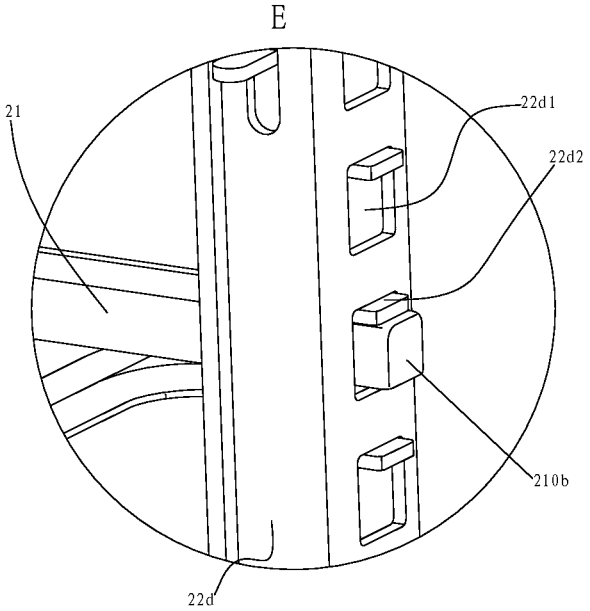
FIG. 11 is an enlarged schematic view of a portion indicated by Circle E in FIG. 10.

As shown in FIGS. 10-11, the fitting slot of the fourth bracket includes a plurality of positioning grooves 22*d*1 spaced apart from each other along the vertical direction, the fourth mounting member is selectively fitted within the positioning grooves of the fourth bracket. It is understandable that the third and fourth brackets are symmetrical in left-right direction. The fitting slot of the third bracket includes a plurality of positioning grooves (not shown) spaced apart from each other along the vertical direction, the third mounting member is selectively fitted within the positioning grooves of the third bracket.

Figure 12:
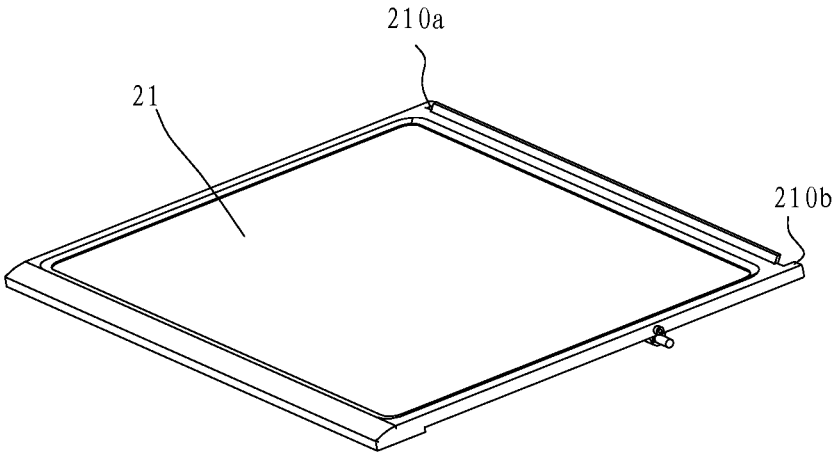
FIG. 12 is another schematic view of a shelf plate of the shelf assembly according to an embodiment of the present disclosure.
Figure 13:
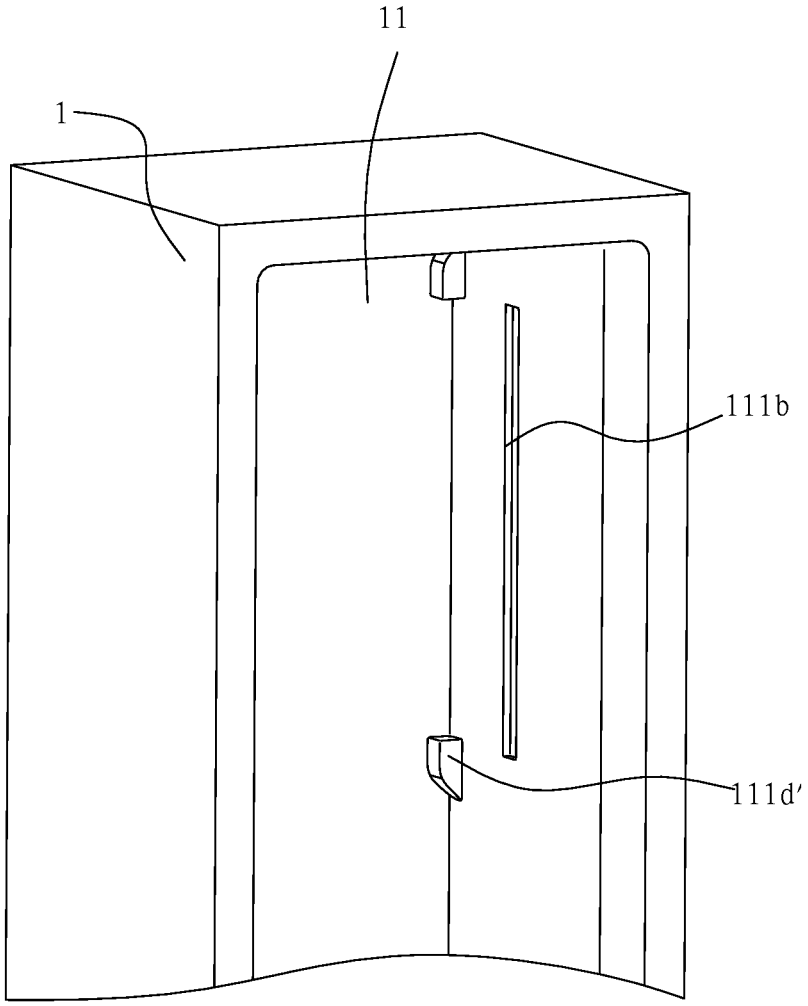
FIG. 13 is a first schematic view of a refrigerator according to an embodiment of the present disclosure.
Figure 14:
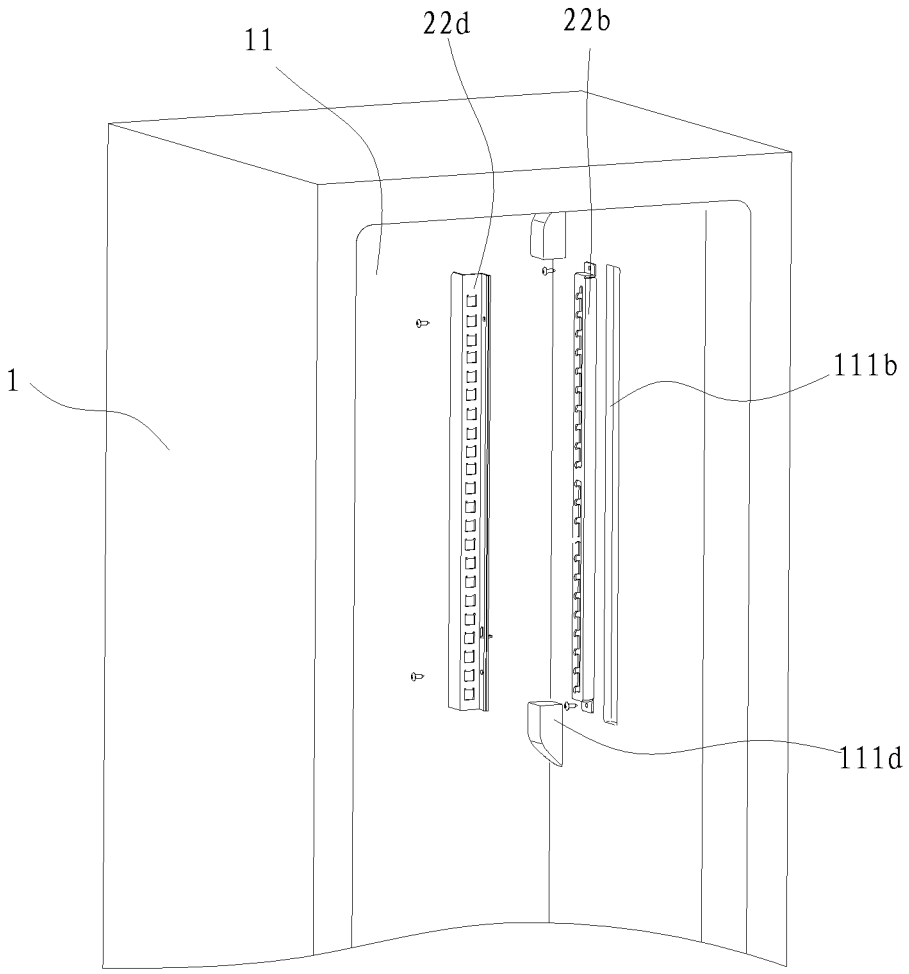
FIG. 14 is a second schematic view of a refrigerator according to an embodiment of the present disclosure.
Figure 15:
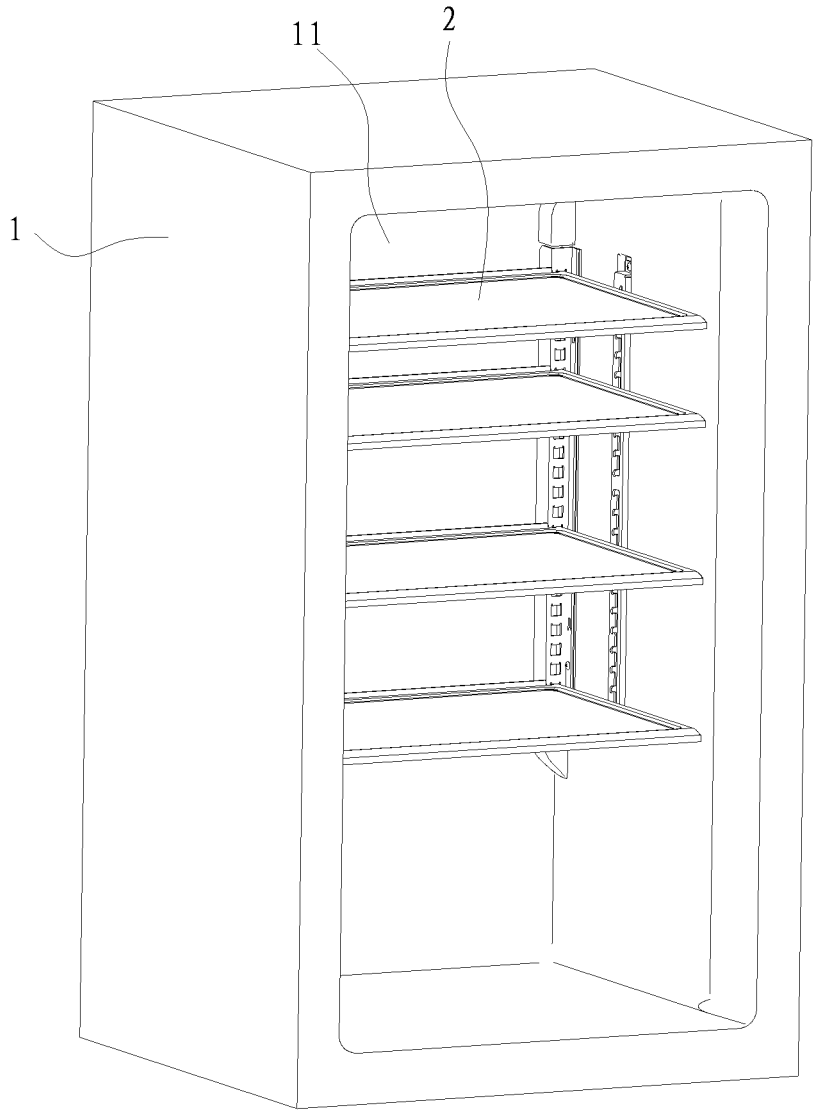
FIG. 15 is a third schematic view of a refrigerator according to an embodiment of the present disclosure.
Figure 16:
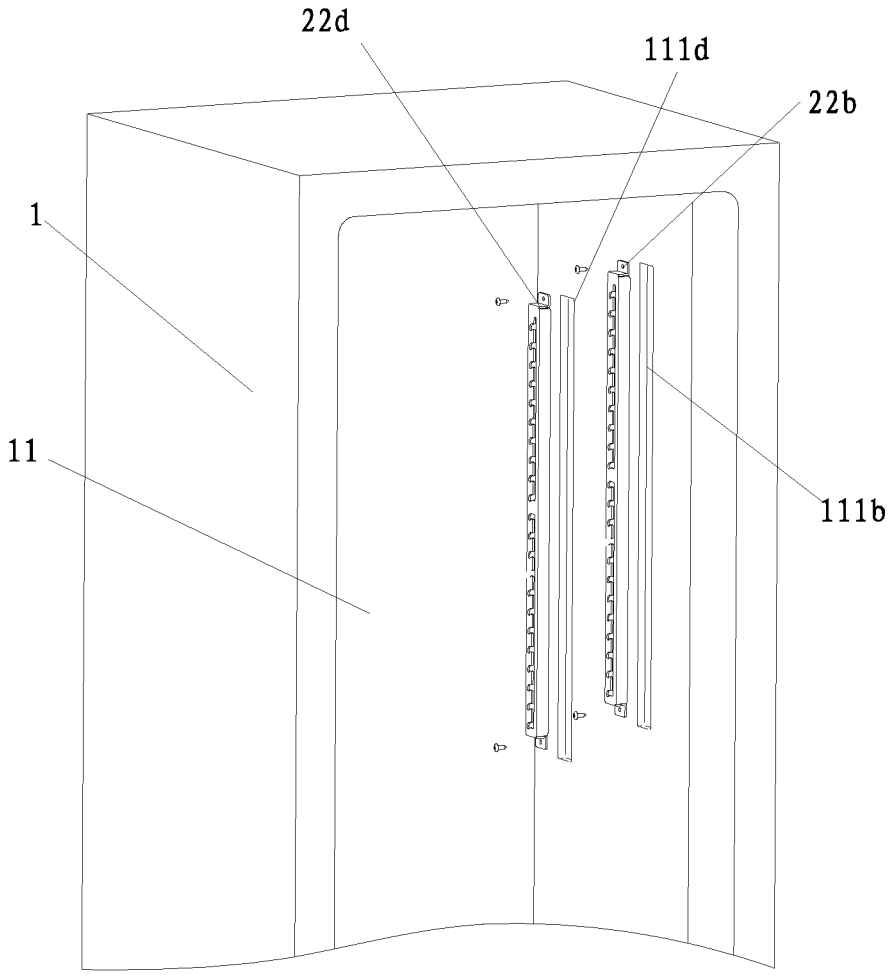
FIG. 16 is a fourth schematic view of a refrigerator according to an embodiment of the present disclosure.
Figure 17:
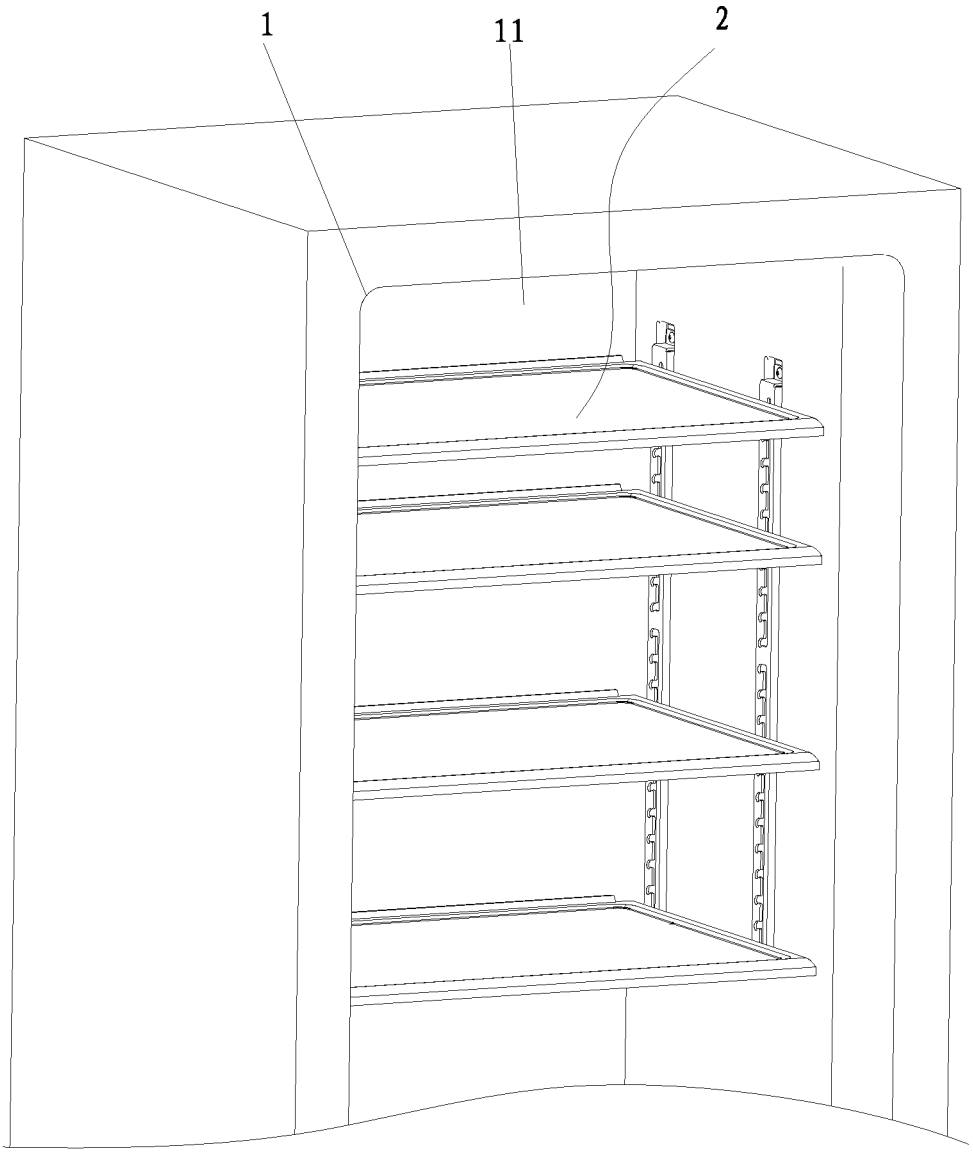
FIG. 17 is a fifth schematic view of a refrigerator according to an embodiment of the present disclosure.

The third mounting member is configured as positioning protrude 210*a* integral with the shelf plate 21. The fourth mounting member is configured as positioning protrude 210*b* integral with the shelf plate 21, as shown in FIG. 12. The positioning protrudes 210*a* and 210*b* are configured as square posts, and each of the positioning grooves is configured as a square hole adapted to the positioning protrudes. As shown in FIG. 11, a flange 22*d*1 extended backwards is formed on a top edge of the positioning groove 22*d*1 of the fourth bracket 22*d*. Correspondingly, a flange extended backwards is formed on a top edge of the positioning groove of the third bracket.

Alternatively, the first and second bracket 22*a* and 22*b* may be identical with that in the embodiments mentioned above, which will not be described herein in detail.

Particularly, the support shaft of the first mounting member is slidable within the first sliding groove of the first bracket along the vertical direction so as to selectively fit within one of the plurality of the first receiving grooves of the first bracket 22*a*. The support shaft of the second mounting member is slidable within the first sliding groove of the second bracket along the vertical direction so as to selectively fit within one of the plurality of the first receiving grooves of the second bracket 22*b*. The positioning protrude 210*a* of the third mounting member is inserted into the positioning groove of the third bracket 22*c*, and the positioning protrude 210*b* of the fourth mounting member is inserted into the positioning groove 22*d*1 of the fourth bracket 22*d*. The receiving grooves and the positioning grooves are one-one corresponding horizontally. When the vertical position of the shelf plate 21 need to be adjusted, the third and fourth mounting members are released from the positioning grooves, and the first and second mounting members are released from the receiving grooves and enter into the sliding grooves. Once the shelf plate 21 is moved vertically to a predetermined position, the first and second mounting members enter into the corresponding receiving grooves and the third and fourth mounting members are fitted into the positioning grooves. Therefore, the position adjustment of the shelf plate is achieved.

The refrigerator according to embodiments of the present disclosure will be described below with reference of FIGS. 13-19.

As shown in FIGS. 13-19, the refrigerator according to an embodiment of the present disclosure includes: a cabinet 1, a door (not shown), and a shelf assembly 2 described in above embodiments.

Particularly, the cabinet 1 defines a compartment 11 therein. The door is pivotably disposed on a front side of the cabinet 1 for opening or closing the compartment 11. The shelf assembly 2 is disposed in the compartment 11. The first bracket 22*a*, the second bracket 22*b*, the third bracket 22*c*, and the fourth bracket 22*d* are mounted on inner walls of the compartment 11. The shelf assembly 2 may be any described with reference to above embodiments, which will not described in detail herein.

With the refrigerator according to embodiments of the present disclosure, the position of the shelf plate 21 of the shelf assembly 2 may be adjusted along the vertical direction easily and simply, thus enhancing the practicability.

In a particular embodiment, a first mounting groove (not shown) extended along the vertical direction is formed in a left inner wall of the compartment 11, and a second mounting groove 111*b* extended along the vertical direction is formed in a right inner wall of the compartment 11. First mounting projections (not shown) are disposed on the left inner wall of the compartment 11, close to a rear inner wall and spaced apart from each other in the vertical direction, and second mounting projections 111*d* are disposed on the right inner wall of the compartment 11, close to a rear inner wall and spaced apart from each other in the vertical direction. The first bracket 22*a* is mounted in the first mounting groove, such as via snap-fit or by means of screws. The second bracket 22*b* is mounted in the second mounting groove, such as via snap-fit or by means of screws. The third bracket 22*c* is mounted on the first mounting projections, such as via snap-fit or by means of screws. And the fourth bracket 22*d* is mounted on the second mounting projections, such as via snap-fit or by means of screws.

Figure 18:
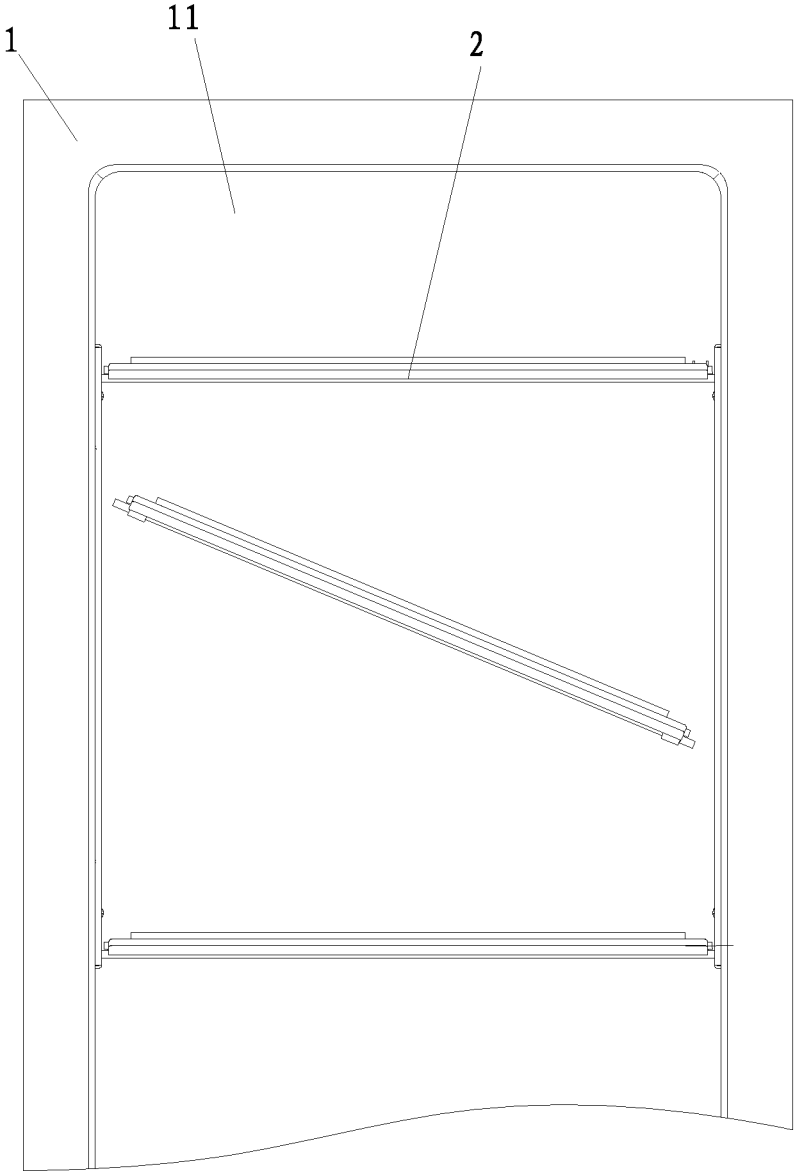
FIG. 18 is a sixth schematic view of a refrigerator according to an embodiment of the present disclosure.

In other words, the first to fourth brackets 22*a*-22*d* are firstly mounted on inner walls of the compartment 11, and then the shelf plate 21 is coupled with and supported by the first to fourth brackets 22*a*-22*d*. For example, the shelf plate 21 is inclined downwardly from left to right as shown in FIG. 18, to fit the first and third mounting members into the first and third brackets respectively, and then the shelf plate 21 is rotated around a horizontal axis to fit the second and fourth mounting members into the second and fourth brackets respectively. Finally, the first and second mounting members are positioned respectively into the first receiving grooves of the first and second brackets, and the third and fourth mounting members are positioned respectively into the second receiving grooves of the third and fourth brackets (alternatively, the first and second mounting members are positioned respectively into the receiving grooves of the first and second brackets, and the third and fourth mounting members are positioned respectively into the positioning grooves of the third and fourth brackets).

With the shelf assembly for a refrigerator according to embodiments of the present disclosure, the shelf plate is supported by the first to fourth brackets 22*a*, 22*b*, 22*c*, 22*d* via the first to fourth mounting members respectively and correspondingly, and the position of the shelf plate 21 is adjustable along the vertical direction. Therefore, the shelf plate 21 can be disposed on the brackets steadily, the position adjustment of the shelf plate 21 is easy and convenient, and the structure of the shelf plate 21 is simple.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A shelf assembly for a refrigerator, comprising:

a shelf plate comprising first to fourth mounting members, and first to fourth brackets each having a fitting slot, wherein the first bracket is disposed at a left side of the shelf plate, and the second bracket is disposed at a right side of the shelf plate, wherein the fitting slot of each of the first and second brackets comprising a first sliding groove extended along a vertical direction and a plurality of first receiving grooves which are formed in a back wall of the first sliding groove, communicated with the first sliding groove respectively and spaced apart from each other along the vertical direction, wherein the first mounting member is slidable within the first sliding groove of the first bracket along the vertical direction so as to selectively fit within one of the plurality of the first receiving grooves of the first bracket, wherein the second mounting member is slidable within the first sliding groove of the second bracket along the vertical direction so as to selectively fit within one of the plurality of the first receiving grooves of the second bracket, wherein the third mounting member is fitted within the fitting slot of the third bracket and a position of the third mounting member is adjustable along the vertical direction, wherein the fourth mounting member is fitted within the fitting slot of the fourth bracket and a position of the fourth mounting member is adjustable along the vertical direction, wherein the third bracket is disposed at the left side of the shelf plate and spaced apart from the first bracket along a front and back direction, wherein the fourth bracket is disposed at the right side of the shelf plate and spaced apart from the second bracket along the front and back direction, wherein left stopping members for abutting against the first and third brackets are disposed on a left side surface of the shelf plate and spaced apart from each other in the front and back direction, and wherein right stopping members for abutting against the second and fourth brackets are disposed on a right side surface of the shelf plate and spaced apart from each other in the front and back direction.

2. The shelf assembly as set forth in claim 1, wherein the fitting slot of each of the third and fourth brackets comprising a second sliding groove extended along the vertical direction and a plurality of second receiving grooves which are formed in a back wall of the second sliding groove, communicated with the second sliding groove respectively and spaced apart from each other along the vertical direction, the third mounting member is slidable within the second sliding groove of the third bracket along the vertical direction so as to selectively fit within one of the plurality of the second receiving grooves of the third bracket, and wherein the fourth mounting member is slidable within the second sliding groove of the fourth bracket along the vertical direction so as to selectively fit within one of the plurality of the second receiving grooves of the fourth bracket.

3. The shelf assembly as set forth in claim 2, wherein the first to fourth mounting members are disposed on a bottom surface of the shelf plate, the first and third mounting members are extended beyond the left side surface of the shelf plate and spaced apart from each other in the front and back direction, the second and fourth mounting members are extended beyond the right side surface of the shelf plate and spaced apart from each other in the front and back direction.

4. The shelf assembly as set forth in claim 3, wherein each of the first to fourth mounting members includes:

a mounting block disposed on the bottom surface of the shelf plate and having a mounting hole;

a support shaft fitted within the mounting hole and extended beyond the shelf plate;

wherein the support shafts of the first and second mounting members are slidable within the first sliding groove of the first and second brackets along the vertical direction so as to selectively fit within one of the plurality of the first receiving grooves of the first and second brackets, respectively, wherein the support shafts of the third and fourth mounting members are slidable within the second sliding groove of the third and fourth brackets along the vertical direction so as to selectively fit within one of the plurality of the second receiving grooves of the third and fourth brackets, respectively.

5. The shelf assembly as set forth in claim 4, wherein the support shafts of the first and second mounting members are integral with each other, and the support shafts of the third and fourth mounting members are integral with each other.

6. The shelf assembly as set forth in claim 4, wherein a recess is formed in an inner wall of the mounting hole, and the support shaft has an anti-rotation protrude formed thereon and fitted within the recess.

7. The shelf assembly as set forth in claim 1, wherein the shelf plate, the left and right stopping members, and the mounting blocks are integral.

8. The shelf assembly as set forth in claim 1, wherein the receiving groove transitions into the sliding groove via an arc transition surface, and an arc recession is formed at a bottom of the receiving groove.

9. A refrigerator, comprising:

a cabinet defining a compartment therein;

a door pivotably disposed on a front side of the cabinet for opening or closing the compartment; and a shelf assembly disposed in the compartment and comprising, a shelf plate comprising first to fourth mounting members, and first to fourth brackets mounted on inner walls of the compartment and each having a fitting slot, wherein the first bracket is disposed at a left side of the shelf plate, and the second bracket is disposed at a right side of the shelf plate, wherein the fitting slot of each of the first and second brackets comprising a first sliding groove extended along a vertical direction and a plurality of first receiving grooves which are formed in a back wall of the first sliding groove, communicated with the first sliding groove respectively and spaced apart from each other along the vertical direction, wherein the first mounting member is slidable within the first sliding groove of the first bracket along the vertical direction so as to selectively fit within one of the plurality of the first receiving grooves of the first bracket, wherein the second mounting member is slidable within the first sliding groove of the second bracket along the vertical direction so as to selectively fit within one of the plurality of the first receiving grooves of the second bracket, wherein the third mounting member is fitted within the fitting slot of the third bracket and a position of the third mounting member is adjustable along the vertical direction, wherein the fourth mounting member is fitted within the fitting slot of the fourth bracket and a position of the fourth mounting member is adjustable along the vertical direction, wherein left stopping members for abutting against the first and third brackets are disposed on a left side surface of the shelf plate and spaced apart from each other in a front and back direction, and wherein right stopping members for abutting against the second and fourth brackets are disposed on a right side surface of the shelf plate and spaced apart from each other in the front and back direction.

* * * * *